US007832421B2

(12) United States Patent
Laing

(10) Patent No.: US 7,832,421 B2
(45) Date of Patent: Nov. 16, 2010

(54) SYSTEM AND METHOD FOR MAKING HOT WATER AVAILABLE IN A DOMESTIC WATER INSTALLATION AND DOMESTIC WATER INSTALLATION

(75) Inventor: Oliver Laing, Stuttgart (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 1421 days.

(21) Appl. No.: 10/819,455

(22) Filed: Apr. 6, 2004

(65) Prior Publication Data

US 2005/0001046 A1 Jan. 6, 2005

(51) Int. Cl.
*F16L 53/00* (2006.01)

(52) U.S. Cl. ..... 137/337; 417/12; 417/32; 417/63

(58) Field of Classification Search ..... 137/337; 126/362; 417/12, 32, 63
See application file for complete search history.

(56) References Cited

U.S. PATENT DOCUMENTS

| | | | | |
|---|---|---|---|---|
| 4,142,515 | A * | 3/1979 | Skaats | 122/13.3 |
| 4,201,518 | A * | 5/1980 | Stevenson | 417/12 |
| 4,606,325 | A * | 8/1986 | Lujan, Jr. | 122/13.3 |
| 4,750,472 | A * | 6/1988 | Fazekas | 122/13.3 |
| 4,936,289 | A * | 6/1990 | Peterson | 122/13.3 |
| 5,351,712 | A * | 10/1994 | Houlihan | 137/337 |
| 5,775,372 | A * | 7/1998 | Houlihan | 137/624.12 |
| 5,941,275 | A | 8/1999 | Laing | |
| 5,944,221 | A | 8/1999 | Laing et al. | |
| 5,983,922 | A | 11/1999 | Laing et al. | |
| 6,026,844 | A | 2/2000 | Laing et al. | |
| 6,039,067 | A * | 3/2000 | Houlihan | 137/337 |

FOREIGN PATENT DOCUMENTS

| | | |
|---|---|---|
| DE | 36 19 217 A1 | 12/1987 |
| DE | 197 12 051 A1 | 9/1998 |
| DE | 100 24 803 A1 | 11/2000 |

OTHER PUBLICATIONS

Laing Thermotech, Inc., "How Hot Water Recirculating Systems Work," http://www.lainginc.com/howhot.htm (2001).
Laing Thermotech, Inc., "Laing Autocirc—How the Autocirc System Works," http://www.autocirc.com/Autocirc.htm (2001).
Laing Thermotech, Inc., "Installation and Operating Manual," (2002).
Laing Thermotech, Inc., "Hot Water Recirculation—How It Works," www.grundfos.com.

* cited by examiner

*Primary Examiner*—Stephen Hepperle
*Assistant Examiner*—Andrew J Rost
(74) *Attorney, Agent, or Firm*—RatnerPrestia

(57) ABSTRACT

A method, system and device for making hot water available in a water-supply system is disclosed. The water-supply system includes a source of hot water, a hot-water line and one or more tap connections for hot water connected to the hot-water line. The method includes transporting water from the source of hot water through the hot-water line during at least a portion of periods of non-withdrawal through the one or more tap connections such that a temperature profile of water in the hot water line is at least one of substantially temporally constant and varying spatially monotonically along the hot-water line.

13 Claims, 2 Drawing Sheets

SYSTEM AND METHOD FOR MAKING HOT WATER AVAILABLE IN A DOMESTIC WATER INSTALLATION AND DOMESTIC WATER INSTALLATION

The present disclosure relates to the subject matter disclosed in German application No. 103 18 821.5 of Apr. 16, 2003, which is incorporated herein by reference in its entirety and for all purposes.

BACKGROUND OF THE INVENTION

The invention relates to water supply systems. In particular, the invention relates to methods and systems for improving availability of hot water.

Domestic water installations are known, for example, from U.S. Pat. Nos. 5,983,922 A, 5,941,275 A, 6,026,844 A and 5,944,221 A.

Furthermore, such domestic water installations are known under the name "Autocirc" and "Recirc" of the companies Laing GmbH Systeme fuer Waermetechnik, Klingelbrunnenweg 4, 71686 Remseck, Germany and Laing Thermotech, Inc., 2295 Main Street, San Diego, Calif. 92 154 USA.

In the case of domestic water installations, the fundamental problem with respect to making hot water available is that the water can cool down in the hot water line and cooled water is available immediately after opening a faucet at a tap connection for withdrawing hot water. It is known to provide a thermostat control, with which water is circulated via a circulation pump, wherein the circulation pump is switched on when the water reaches a specific, lower temperature at a sensor and the circulation pump is switched off when the water reaches a specific, higher temperature.

It is also known to switch a water circulation on and off via a time-switch clock.

SUMMARY OF THE INVENTION

In an embodiment of the present invention, a method for making hot water available in a water-supply system is provided. The water-supply system includes a source of hot water, a hot-water line and one or more tap connections for hot water connected to the hot-water line. The method includes transporting water from the source of hot water through the hot-water line during at least a portion of periods of non-withdrawal through the one or more tap connections such that a temperature profile of water in the hot water line is at least one of substantially temporally constant and varying spatially monotonically along the hot-water line.

In particular embodiments, the temperature profile includes a specific temperature at one of the tap connections within a predetermined range. The specific temperature may be between 27° C. and 35° C.

In particular embodiments, the step of transporting includes transporting water in cycles of pulses and pauses, wherein a pulse-pause ratio is selected such that water in the hot-water line does not substantially cool during the pauses. The pauses may have the same length during each cycle. The length of the pulses may vary across the cycles.

In an embodiment, the step of transporting includes transporting water during non-withdrawal times at a substantially constant rate.

In another embodiment, the step of transporting includes transporting water during non-withdrawal times at a substantially constant rate with periodic pause times. The pause times may have a length selected to prevent substantially cooling of water in the hot-water line.

In certain embodiments, the step of transporting includes actuating a circulation pump to transport water through said hot-water line. In other embodiments, the step of transporting includes actuating a valve to control transport of water through the hot-water line.

The method may also include returning water to the source through a recirculation line linked to the hot-water line proximate to a last one of the tap connections. The step of returning may include actuating a circulation pump to return water through the recirculation line. The circulation pump may be arranged proximate to the last one of the tap connections. Alternatively, the circulation pump may be arranged proximate to the source of hot water.

In other embodiments, the method may include returning water to a cold-water line coupled to the hot water line proximate to a last one of the tap connections.

In another aspect of the invention a control device for a water supply system. The water-supply system includes a source of hot water, a hot water line and one or more tap connections for hot water connected to the hot water line. The control device includes means for controlling transport of water through the hot water line during at least a portion of periods of non-withdrawal of hot water by the tap connections such that a temperature profile of water in the hot water line is at least one of substantially temporally constant and varying spatially monotonically along the hot-water line.

In another aspect, the invention includes a circulation pump for a water-supply system. The water-supply system includes a source of hot water, a hot water line and one or more tap connections for hot water connected to the hot water line. The circulation pump includes a control device for controlling transport of water through the hot water line during at least a portion of periods of non-withdrawal of hot water by the tap connections such that a temperature profile of water in the hot water line is at least one of substantially temporally constant and varying spatially monotonically along the hot-water line.

In still another aspect, the invention provides a water-supply system having a supply of hot water, a hot water line, one or more tap connections for hot water connected to the hot water line, and a control device. The control device is adapted to control transport of water through the hot water line during at least a portion of periods of non-withdrawal of hot water by the tap connections such that a temperature profile of water in the hot water line is at least one of substantially temporally constant and varying spatially monotonically along the hot-water line.

The following description of preferred embodiments serves to explain the invention in greater detail in conjunction with the drawings.

DETAILED DESCRIPTION OF THE INVENTION

Figure 1:
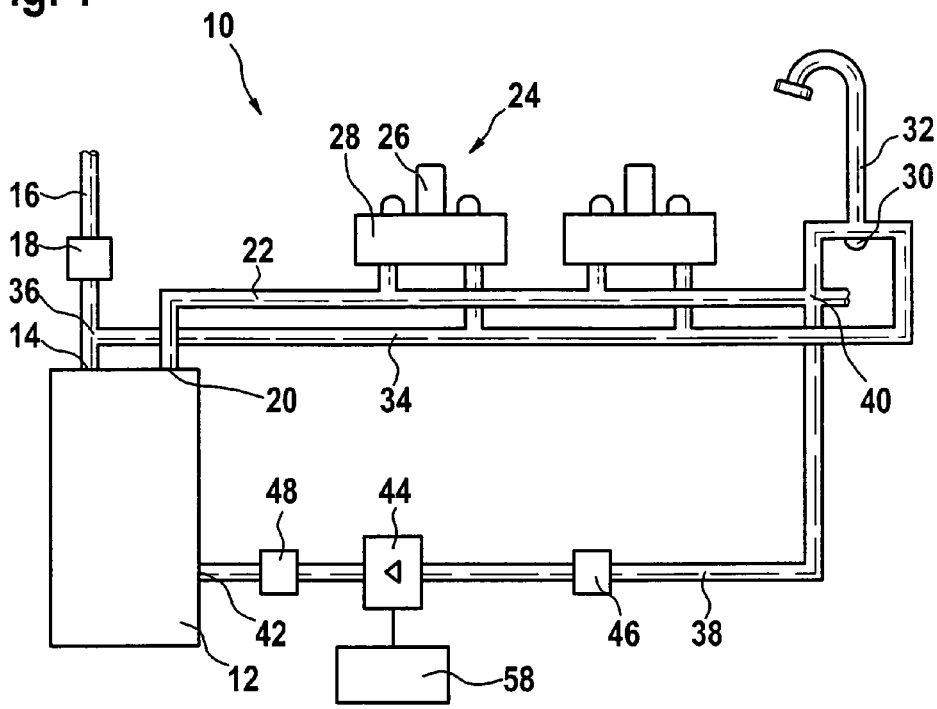
FIG. 1 shows a schematic illustration of a first embodiment of a domestic water installation with a recirculation line.

The invention relates to methods and systems for making hot water available in a domestic water installation which comprises a source of hot water, a hot water line and one or more tap connections for hot water connected to the hot water line.

The invention relates, in addition, to a control device for a domestic water installation.

Furthermore, the invention relates to a domestic water installation, comprising a reservoir for hot water, a hot water line and one or more tap connections for hot water which are connected to the hot water line.

In accordance with embodiments of the present invention, a method, a control device and a domestic water installation, by which water consumption and energy consumption can be reduced, are disclosed.

This is, in accordance with embodiments of the present invention, accomplished in that during non-withdrawal times of hot water, the amount of water transported in the hot water line is such that a temperature profile which is temporally essentially constant and falls spatially monotonically away from the source of hot water is set in the hot water line.

Thus, a quasi-stationary circulation can result due to a permanent transport of water (which need not necessarily be continuous) even during non-withdrawal times. Embodiments of the invention can prevent discontinuities in the distribution of temperature along the hot water line.

In practice, it is often the case that part of the warm water line extends within or beneath a concrete ceiling or within a concrete floor, and the hot water can cool down to a greater extent in these areas than in the remaining sections of the hot water line. If hot water is then withdrawn, when a thermostat control is provided, water of a desired temperature may exit from the corresponding tap connection, but cooler water exits at a later point in time when the water standing in the concrete area reaches the tap connection. This effect is particularly undesirable when showering since colder water then exits after the desired temperature has been set.

Embodiments of the present invention make it possible to avoid water being contained in the hot water line which has a discontinuous temperature with respect to the remaining temperature profile. As a result of the fact that water is substantially constantly transported, such a temperature discontinuity is avoided. It is possible to avoid colder water exiting with a temporal delay after a hot water tap has been opened when a temperature profile which is temporally essentially constant and a temperature profile which falls spatially monotonically are set. In accordance with embodiments of the invention, a quasi-stationary temperature profile is set via a quasi-stationary transport of hot water.

A "point-exact" adjustment of the water temperature of the hot water along the hot water line results on account of the temperature profile which is temporally essentially constant and falls spatially monotonically. There is, in particular, no "overshooting" with respect to the temperature, such as is the case, for example, with a thermostat solution.

For example, controlled thermostats may have a significant hysteresis. On account of this hysteresis, the average temperature can be, for example, about 5 degrees higher than the temperature actually desired. As a result, higher temperature losses are generated.

As a result of embodiments of the present invention, water and energy may, therefore, be saved, and the ease of operation may be increased.

A quasi-stationary state may be created in the hot water line during non-withdrawal times for hot water. During withdrawal, a shift occurs since a considerably greater amount of hot water then flows through the hot water line. During withdrawal times, the disclosed embodiments may not be used.

The inventive solution may be realized in a simple manner with minimization of energy resources. No great constructional resources are required in order to bring about the quasi-stationary transport of water, in particular, when the corresponding domestic water installation is already provided with a circulation pump.

A minimized amount of water is advantageously circulated in order to set a temperature profile with an acceptable temperature at the last tap connection (typically 28° C.). As a result, the energy required for setting the corresponding temperature profile is minimized.

It is provided for the amount of water transported on average over time to be such that any deviation from the desired temperature profile on account of cooling of the water is counteracted. A type of dynamic balance is therefore created in order to achieve the desired temperature curve, namely temporally constant and falling spatially monotonically.

The amount of water transported is preferably such that hot water having a specific temperature is available at the last tap connection with respect to the distance to the source of hot water. This specific temperature is, however, a temperature which is still acceptable (if the temperature is selected to be too low, it is no longer acceptable for a person using the hot water; if it is selected to be too high, this leads to an unnecessary consumption of energy). The corresponding temperature can be monitored in a simple manner via a temperature sensor in order to make a control parameter available for the control/regulation of the transport of the amount of water.

It is preferable that when the specific temperature is between 27° C. and 35° C. and, most preferably, is at 28° C.

In principle, it is possible to operate a circulation pump with low power constantly in order to bring about a continuous throughput of water. Since pumps with such a low throughput generally cannot be obtained commercially, it has proven to be advantageous in practice when water is transported cyclically, wherein a pulse-pause ratio is selected such that no fundamental cooling of the water takes place in the pause times. Conventional circulation pumps, which have, for example, a power requirement on the order of 30 W, can be used with this embodiment. The amount of water transported through the hot water line which is coupled to the energy consumption may be minimized via the pause times. When, on the other hand, the pause times are selected to be so short that no fundamental cooling takes place, the desired temperature profile is not influenced to any great extent by the pause times.

A quasi-stationary circulation with a temperature profile set in a defined manner is, therefore, obtained by means of this solution.

It is, in principle, possible to control the pulse times and/or pause times. It is also possible to control or rather regulate the pulse-pause ratio. It is favorable when pause times have essentially the same length. For example, the pause times may be fixed times, and the pulse times may be varied. Cooling of the water in the hot water line takes place during the pause times, wherein this cooling is determined by external circumstances (arrangement and design of the hot water line, external temperature, etc.) which cannot, generally, be influenced or controlled. It is then favorable when the pulse times are variable and are controlled and/or regulated accordingly in setting of the temperature profile. Typical pause times may be, for example, on the order of 5 seconds to 20 seconds. In the case of a thermostat solution known from the state of the art, typical pause times are, in this respect, 15 minutes, wherein these times are not, however, fixed times.

When hot water is withdrawn, hot water is supplied in the hot water line in a considerably greater amount than at non-withdrawal times, and the temperature profile set during non-withdrawal times is altered accordingly. During the withdrawal of hot water, a check valve may be closed so that no profile-related circulation takes place. In order to provide the quasi-stationary temperature profile again following the withdrawal, it is provided, for example, for the pulse times of the circulation pump to be lowered to a minimum value. If the temperature of the hot water exceeds a predetermined triggering value, the pulse times may not be reduced further, but rather kept at a specific value (for example, 2 seconds) and the pause times extended. Typical values for the pause times may then be 20 seconds to 600 seconds for a certain period following the withdrawal of hot water.

In accordance with embodiments of the invention, a constant throughput of water through the hot water line takes place during non-withdrawal times, and this is interrupted at the most for pause times which are selected so that no fundamental temporal variations in the temperature of the water in the hot water line take place. The throughput of water is, therefore, "quasi-continuous" with respect to the temperature curve.

It is particularly advantageous when a circulation pump effects the transport of water. The method can then be carried out advantageously via control of the circulation pump.

It may also be provided, alternatively or in addition, for the transport of water to be controlled via a valve. Such a valve may be connected in front of or behind a circulation pump. The circulation pump can then be operated continuously whereas the valve is "digitally" connected cyclically or, preferably connected continuously with control of the amount of throughput in order to be able to transport the corresponding amount of water in the hot water line, with which the desired temperature profile is set.

In one embodiment, a recirculation line is provided, through which hot water is returned to the source of hot water. A transport of hot water in the hot water line may be realized in a simple manner via such an additional recirculation line.

In this respect, a circulation pump may be coupled to the recirculation line in order to provide for the return of water to the source of hot water. The circulation pump may be arranged in the vicinity of the last tap connection with respect to the distance from the source of hot water. In some respects, may be advantageous when the circulation pump is arranged in the vicinity of the source of hot water. Electrical sockets are generally present at the source of hot water in order to make a power supply available for the circulation pump. In addition, the corresponding space is normally present in the vicinity of the source of hot water in order to be able to arrange the circulation pump. The power supply may be problematic in the vicinity of the last tap connection and, in particular, beneath a washstand when no socket is present. Furthermore, the space for accommodating the circulation pump may also not be available at this location.

In a further embodiment, the amount of water transported in the hot water line is controlled by hot water from the hot water line being coupled into a cold water line. A return of hot water is brought about by way of the coupling into the cold water line without any special recirculation line needing to be provided. The embodiment may be realized with a corresponding control and/or regulation when hot water from the hot water line is coupled into the cold water line.

For example, a controllable circulation pump is provided for this purpose between the hot water line and the cold water line in the vicinity of the last tap connection. The corresponding amount of water may then be controlled via the pump in order to set the desired temperature profile.

A controllable valve may, alternatively, be provided between the hot water line and cold water line in the vicinity of the last tap connection. The corresponding amount of water, which is transported by a circulation pump, may then be coupled into the cold water line by means of this valve in a controlled manner in order to generate the desired temperature curve. The temperature of the hot water to be coupled into the cold water line may be controlled in a point-exact manner by means of the inventive method, with which a controllable circulation pump or a corresponding controllable valve is provided. As a result, it may be ensured that statutory or regulatory temperature specifications for water returned through the cold water line are not exceeded. For example, hot water may be coupled into the cold water line which has a temperature which is 2 degrees lower than prescribed in order to ensure that legal provisions are adhered to.

In this connection it may be provided for a circulation pump to be coupled to the cold water line via a bypass. This has the advantage that the corresponding circulation pump need not be arranged in the vicinity of the last tap connection, such as, for example, under a washstand, but rather in an area, in which sockets are present and in which sufficient space is available. When the circulation pump is seated in a bypass, it may be possible to provide for a transport of water contrary to the normal direction of flow of the cold water in the cold water line with respect to the withdrawal of the cold water. As a result, the pump does not hinder the normal flow of cold water for the withdrawal of cold water while, with low constructional resources, a return of warm water via the cold water line is made possible in a controlled manner. As a result of the fact that the circulation pump is seated in a bypass, cold water may also be prevented from flowing through it (backwards).

A direction of flow of water through the circulation pump is directed contrary to the normal direction of flow of the water in the cold water line. For example, the direction of transport of the circulation pump may be directed contrary to the normal direction of flow.

It may be provided for the valve and the circulation pump to be coupled to one another with respect to control of the transport of water in order to make an adapted control possible in this way. As a result, the normal flow of cold water is not hindered. The coupling may be brought about, for example, in a radio-controlled manner in that the circulation pump is switched on/switched off when the valve is opened/closed or the power of the circulation pump is controlled or regulated accordingly depending on the amount of water passing through the valve.

It is also possible to control or to regulate the power requirement of the circulation pump via the amount of water transported in the cold water line with a decoupled pump-valve combination with respect to control. When a small throughput of water through the pump is present, this heats up. This heating up can be registered. If, on the other hand, a high throughput of water is present, the water cools the pump. If a heating up of the pump is registered, the power of the pump can be reduced to correspond to the small throughput. If the pump cools below a predetermined temperature, the power of the circulation pump can then be increased. As a result, the power requirement of the circulation pump can be controlled indirectly via the pump temperature.

The objective specified at the outset may be accomplished in accordance with embodiments of the invention, in a control device for a domestic water installation which comprises a source of hot water, a hot water line and one or more tap connections for hot water connected to the hot water line, in that the control device can control the fact that, during non-withdrawal times, the amount of water transported in the hot water line is such that a temperature profile that is temporally essentially constant and falling spatially monotonically away from the source of hot water is set in the hot water line.

The embodiments of control device are suitable for carrying out the above-described method.

The advantages of this control device have already been explained in conjunction with the above-described method.

Further, advantageous developments have likewise already been explained in conjunction with the above-described method.

In this respect, it may be provided for the control device to be coupled to a circulation pump. The control device may control and/or regulate the circulation pump. It may, in particular, be integrated into the circulation pump.

It is, however, also possible for the control device to be coupled to a controllable valve. Thus, the control device may control this valve.

The objective specified above may be accomplished in accordance with embodiments of the invention, in a generic domestic water installation, in that a control device is provided, through which it can be controlled that, during non-withdrawal times, the amount of water which can be transported in the hot water line is such that a temperature profile temporally essentially constant and falling spatially monotonically away from the source of hot water is set in the hot water line.

The domestic water installation has the advantages already explained in conjunction with the above-described method.

Further, advantageous developments have likewise already been explained in conjunction with the above-described method.

In certain embodiments, in which the circulation pump is arranged in a bypass of the cold water line, check valves are advantageously provided. A check valve which is arranged in the cold water line and, for example, is acted upon by a spring ensures that the circulation pump does not operate at zero flow when the valve, via which hot water is coupled into the cold water line, is closed. Another check valve serves to block the normal direction of flow of the cold water through the circulation pump.

Referring now to the figures, a first embodiment of a domestic water installation according to the present invention, which is designated in FIG. 1 as a whole as 10, includes a source 12 of hot water, such as, for example, a storage tank for hot water with a heating device coupled thereto. The source 12 of hot water has a connection 14, to which a line 16 is coupled. The source 12 of hot water can be supplied with cold water via this line 16. A check valve 18 is arranged in the line 16. The cold water can then be heated in the source 12.

The source 12 of hot water has an outlet 20, to which a hot water line 22 is connected. Hot water may be drawn from the source 12 of hot water via the outlet 20, and this hot water may be supplied to one or more tap connections 24 via the hot water line 22. The tap connections are, for example, faucets 26. These may be arranged on wash basins, bath tubs or the like. Furthermore, faucets 30 for one or more showers 32 may be provided.

The tap connections 24 are connected one after the other to the hot water line 22 (i.e., they are arranged serially). Accordingly, one tap connection is the last one away from the source 12 of hot water in the direction of flow of the hot water with respect to the hot water line 22. In FIG. 1, this is the shower 32 with its faucet 30.

The outlet 20 is preferably arranged at an upper area of the source 12 of hot water with respect to the direction of gravity.

Furthermore, a cold water line 34 is provided, via which the tap connections 24 are supplied with cold water. For example, a branch 36 is seated for this purpose in the line 16, wherein the cold water line 34 is coupled to an outlet of the branch 36. The faucets 26 and 30 are coupled to the cold water line 34. The check valve 18 can also be arranged beneath the branch 36 (not shown in the drawings).

A recirculation line 38 is provided in the embodiment shown in FIG. 1. This recirculation line is connected to the hot water line 22, wherein a corresponding coupling point 40 is arranged in spatial vicinity to the last tap connection 30.

The circulation line 38 leads to the source 12 of hot water which has a corresponding connection 42. This connection 42 can be arranged to the side. Hot water from the hot water line 22 may be returned to the source 12 of hot water via the recirculation line 38 in order to provide for a circulation of hot water through the domestic water installation 10 in this way.

In a variation of one embodiment, the recirculation line 38 is not guided directly back to the source 12 of hot water but rather is coupled to the line 16.

A circulation pump 44 is seated in the recirculation line 38, and this provides for the transport of water through the recirculation line 38 and, therefore, also through the hot water line 22 (even if no hot water is drawn at the tap connections). Corresponding circulation pumps are described in U.S. Pat. No. 5,941,275 A and U.S. Pat. No. 5,983,922 A. Reference is expressly made to these documents. Such circulation pumps are also known, for example, under the name Laing S1-15 which is sold by the Laing GmbH Systeme fuer Waermetechnik, Klingelbrunnenweg 4, 71686 Remseck, Germany.

One or more check valves 46 can be coupled to the recirculation line 38. Furthermore, a venting device 48 can be provided in order to provide for a continuous venting of bubbles of air, for example.

Hot water is not normally drawn continuously from a domestic water installation 10. This means that, when no special measures are taken, hot water remains in the hot water line 22 over longer periods of time during non-withdrawal times and can cool down. When water is then drawn at a tap connection 24, for example, cooled water flows first, and hot water of the desired temperature is not obtained until after a certain time. This leads to an undesired, increased consumption of water and to waiting times.

With a corresponding thermostat control it is possible, via the recirculation of hot water by means of the recirculation line 30 and the circulation pump 44, for the water in the hot water line 22 not to cool down below a certain temperature. If, however, different cooling rates are present in different areas of the hot water line 22, problems can occur. If, for example, a forward section of the hot water line 22 with respect to the direction leading away from the source 12 of hot water is located beneath or in a slab of concrete, the water cools to a greater extent at this point than in an area of the hot water line 22 which extends in non-concrete walls or ceilings of a house. If a hot water tap is opened, hot water exits first, but this is followed, offset in time, by a surge of colder water. This effect is undesired, particularly, when taking a shower. A user can avoid this effect when he opens the faucet for a sufficient length of time before he uses the hot water. As a result, the water consumption is undesirably increased.

In accordance with embodiments of the invention, it is now provided for the amount of water permanently transported in the hot water line 22 during non-withdrawal times to be such that a temperature profile which is temporally essentially constant and a temperature profile which falls spatially monotonically away from the source of hot water are set in this hot water line. Generally, a quasi-stationary temperature profile falling spatially monotonically may be achieved.

Figure 5:
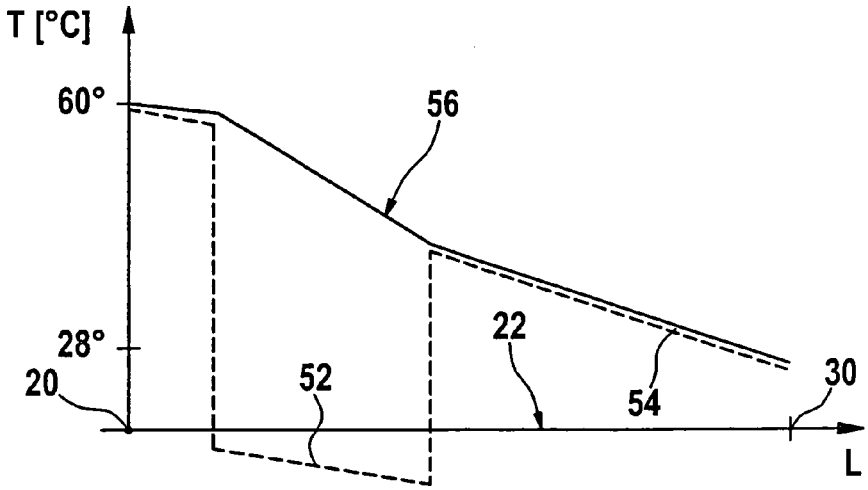

Such a temperature profile is shown in FIG. 5 in solid lines. In the vicinity of the outlet 20 of the source 12 of hot water, the water in the hot water line has essentially the temperature of the water in the source 12 of hot water. On account of the cooling of the water in the hot water line 22, the temperature decreases away from the source 12 of hot water. If the hot water line 22 extends in an area of the house, in which the water can cool to a greater extent, such as, for example, beneath a slab of concrete, the temperature sinks in this area to a considerable extent insofar as no countermeasures are taken. This is indicated in FIG. 5 in broken lines by the area 52. This spatial area, in which a discontinuity of the temperature profile is present, corresponds to that area of the hot water line 22 which is arranged, for example, beneath a slab of concrete. In contrast to the temperature curve 56, which is temporally constant due to the implementation of embodiments of the invention, the temperature curve shown in broken lines is present at a specific moment in time. During the transition of this area 52 into an area 54, in which the hot water line 22 extends, for example, in walls of the house, the temperature rises considerably. It then falls gradually in the direction of the last faucet 30. The discontinuity is undesired.

As a result of the embodiments of the invention, a quasi-stationary circulation can now result which sees to it that the temperature profile during non-withdrawal times of hot water falls spatially monotonically with a good temporal uniformity between the outlet 20 in the hot water line 22 and the last tap connection 30, as indicated in FIG. 5 by the reference numeral 56. This means that hot water below the highest temperature (corresponding to the temperature of the water in the source of hot water) is available immediately when hot water is drawn at any of the tap connections 24 and, afterwards, the water temperature increases gradually since a temperature profile falling monotonically is set. Subsequent delivery of colder water is avoided.

The temperature profile 56 is selected such that hot water having a specific temperature is available at the last tap connection 30 during non-withdrawal times, for example, a temperature of 28° C. A temperature sensor is provided for monitoring this, and the sensor is seated in the vicinity of the last tap connection 30. This supplies a control parameter for the inventive method.

A control device 58 is provided for controlling this transport of water through the water line 22 which is quasi-stationary with respect to the distribution of temperature in the hot water line 22. In the embodiment shown in FIG. 1, this control device 58 is coupled to the circulation pump 44 or integrated into it.

In order to set the temperature curve 56, it may be, in principle, sufficient when a small amount of water is permanently transported through the hot water line 22. It has, however, proven to be advantageous when a specific amount of water is transported cyclically through the hot water line 22. Small amounts of water may also be transported on an average over time, wherein conventional circulation pumps 44 with conventional performance can be used.

The control device 58 controls the circulation pump 44 in such a manner that during pulse times the pump is switched on and water is transported and during pause times no transport of water takes place. The pause times are selected to be so short that no significant cooling of the water in the hot water line 22 takes place during them.

For example, the pause times can be periodic, wherein the pause times have the same length. The pulse times are variable, wherein these are controlled. In the case of deviations from the desired temperature profile 56, the pulse times can be modified in order to achieve the desired quasi-stationary temperature profile 56. A fixed pause time as a function of the installation conditions and the external temperature is typically on the order of 5 seconds to 20 seconds. Pulse times are typically in the range of between 2 seconds and 600 seconds.

According to embodiments of the present invention, a constant throughput of hot water in the hot water line 22 takes place, controlled via the control device 58, wherein the transport of hot water is interrupted during the pause times. The pause times are preferably selected in such a manner that no noticeable cooling of the hot water takes place, and that no essential temporal or spatial deviation from the desired temperature curve 56 is present.

It may be provided for the circulation pump 44 to be arranged in the vicinity of the source 12 of hot water. Since, normally, electrical connections are available in the vicinity of the source 12 of hot water, the power supply to the circulation pump 44 is simplified as a result. In addition, there is normally more room available in the vicinity of the source 12 of hot water for the arrangement of the circulation pump 44. This can also be advantageous for aesthetic reasons.

With this arrangement of the circulation pump 44, the temperature in the temperature curve 56 at the circulation pump 44 is set such that it is below the desired temperature (for example, 28° C.) at the last tap connection 30. As a result, the cooling of the water in the recirculation line between the last tap connection 30 and the circulation pump 44 is taken into account and the energy consumption is reduced.

Alternatively, it may be provided for the circulation pump 44 to be arranged in the vicinity of the last tap connection 30, for example, beneath the last wash basin, insofar as the last tap connection is a wash basin. In FIG. 1, a shower 32 with its faucet 30 is shown as the last tap connection.

With this embodiment, the temperature is set accordingly in order to obtain the desired temperature curve 56 and make hot water having a specific temperature (for example, 28° C.) available at the last tap connection.

Figure 2:
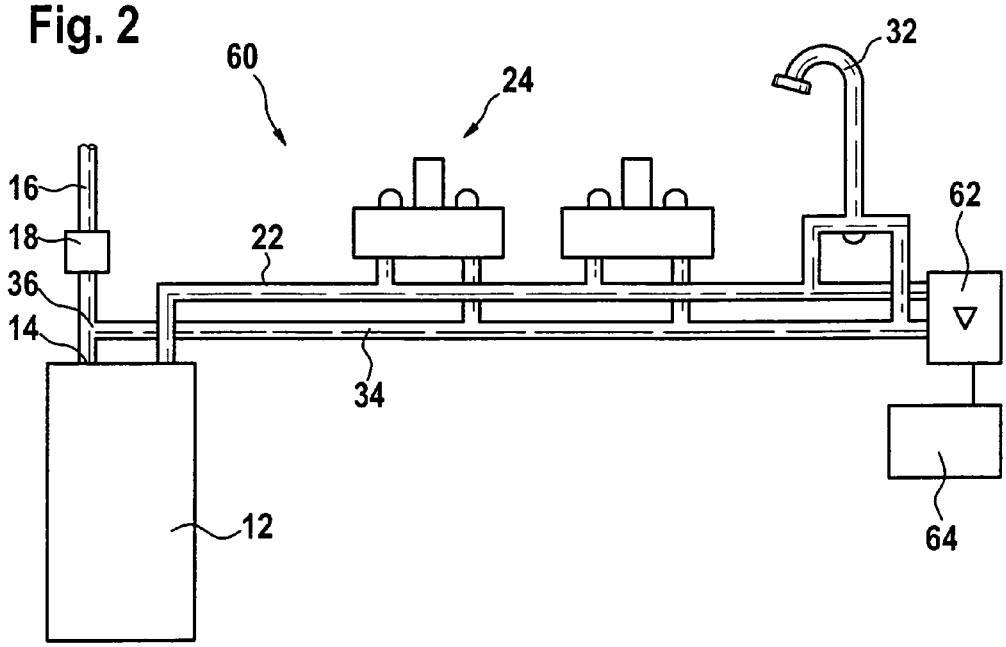
FIG. 2 shows a schematic illustration of a second embodiment of a domestic water installation without a recirculation line.

In a second embodiment of a domestic water installation according to the present invention, which is shown in FIG. 2 and designated as a whole as 60, the fundamental components (e.g., source of hot water 12, hot water line 22, tap connections 24 and cold water line 34) are arranged in the same way as that described above on the basis of the first embodiment 10 illustrated in FIG. 1. The same reference numerals as in FIG. 1 are, therefore, used for these components.

However, in the embodiment illustrated in FIG. 2, no recirculation line is provided. A circulation pump 62 is connected to the cold water line 34 and the hot water line 22, and is arranged in the vicinity of the last tap connection 30, 32. In order to circulate water in the hot water line 22, hot water may be coupled into the cold water line 34 via the circulation pump 62. The circulation pump 62 is arranged, for example, in the hot water line 22 after the last tap connection (in FIG. 2 the shower 32).

A control and/or regulating device 64 is provided which is coupled to the circulation pump 62 or is integrated into it. The circulation pump 62 may be controlled via this control device 64 in such a manner that water from the hot water line 22 can be coupled into the cold water line 34 in accordance with the above-described method in order to provide for a transport of water in the hot water line 22, and to set the quasi-stationary temperature curve 56 with a temperature profile falling spatially monotonically.

Figure 3:
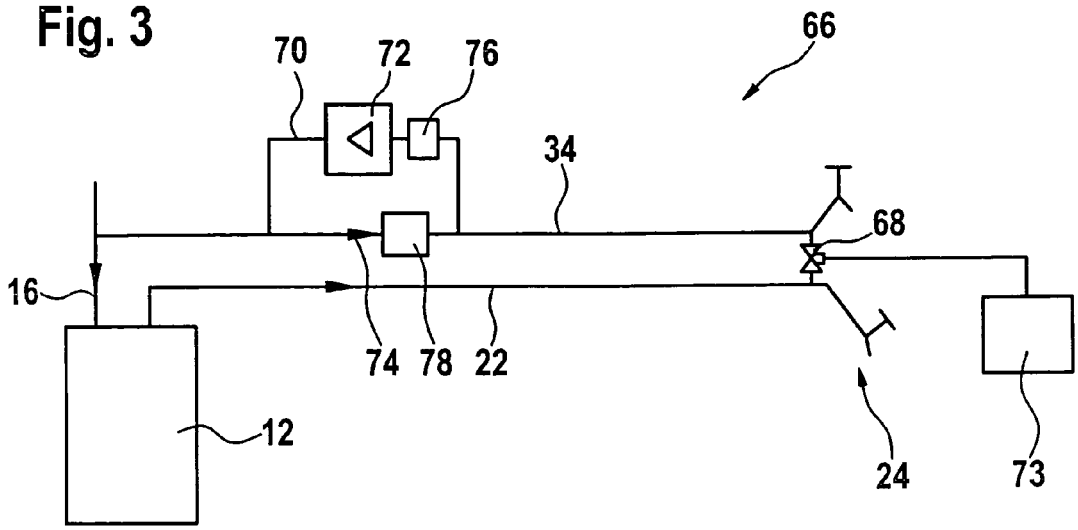
FIG. 3 shows a third embodiment of the present invention without a recirculation line.

A third embodiment, which is shown in FIG. 3 and designated as a whole as 66, is a variation of the domestic water installation 60 shown in FIG. 2. In this case, no recirculation line is again provided.

The hot water line 22 and the cold water line 34 are coupled to one another via a controllable and/or regulatable valve 68. A defined amount of water from the hot water line 22 may be coupled into the cold water line 34 via this valve in order to provide for a quasi-stationary water throughput through the hot water line 22 in order to set the spatial temperature curve 56.

The cold water line 34 is provided with a bypass line 70, in which a circulation pump 72 is seated. The direction of transport of water through the circulation pump 72 is contrary to the normal direction of flow 74 of the cold water for the withdrawal of cold water. A check valve 76 in the bypass line 70 and a check valve 78 in the cold water line 34 each prevent any transport of water in the lines contrary to the desired direction of flow; the check valve 74 therefore prevents any transport of water in the bypass line 70 contrary to the direction of flow through the circulation pump 72 whereas the check valve 78 in the cold water line 34 prevents any flow contrary to the normal direction of flow 74.

The circulation pump 72 in the bypass line 70 is preferably arranged in the vicinity of the source 12 of hot water since a power supply is normally available at this location and enough space is present to accommodate the circulation pump 72 with bypass line 70.

The transport of water through the hot water line 22 is controlled as described above in accordance with the method. For this purpose, a control device 73 is coupled to the valve 68 and controls this. Water is then moved in the cold water line 34 contrary to the normal direction of flow 74. When the valve 68 is opened, a corresponding throughput through the hot water line 22 is provided.

It is particularly advantageous when the circulation pump 72 and the valve 68 are coupled to one another. For example, a radio link may exist between the valve 68 and the circulation pump 72, wherein a battery is, for example, provided for the power supply to the valve 68 when no socket is present for the valve 68. The control and/or regulating device 73 can then control not only the circulation pump 72, but also the valve 68 correlated to one another in order to bring about the desired transport of water in the domestic water installation 66 in order to, again, set the temperature curve 56.

It is also possible to carry out a control indirectly via the heating up of the circulation pump 72. When no water is flowing through, the circulation pump 72 heats up. By reducing the power of the circulation pump 72, the circulation pump 72 cools down. If this cools, on the other hand, to too great an extent, which indicates a high throughput, the power can be increased. The energy consumption of the circulation pump may be reduced via these pump characteristics when this is not coupled to a valve.

Figure 4:
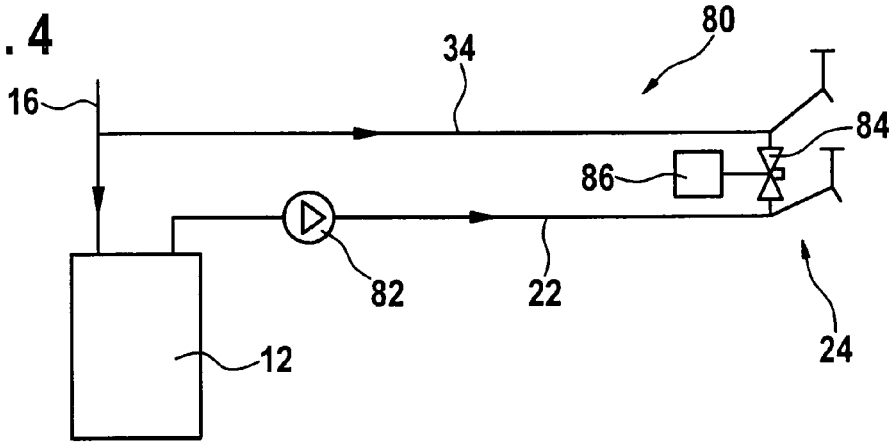
FIG. 4 shows a fourth embodiment of the present invention without a recirculation line and FIG. 5 shows a schematic illustration of the spatial temperature profile in a hot water line of the inventive domestic water installation over a length L of a hot water line (solid lines) in comparison with the temperature profile in the case of conventional methods (broken lines).

A fourth embodiment of a domestic water installation according to the present invention, which is designated in FIG. 4 as a whole as 80, is a variation of the second embodiment 60 illustrated in FIG. 2. The same reference numerals are used for the fundamental components (e.g., source of hot water 12, hot water line 22, tap connections 24 and cold water line 34). In this case, as well, no recirculation line is provided.

A circulation pump 82 is seated in the hot water line 22. A controllable valve 84, which is coupled to a control and/or regulating device 86, is seated between the hot water line 22 and the cold water line 34.

The circulation pump 72 is preferably seated in the vicinity of the source 12 of hot water.

The valve 84 is controlled and/or regulated via the control device 86 such that a corresponding amount of water from the hot water line 22 is coupled into the cold water line 34 in order to set the desired temperature curve 56.

With this embodiment, the pumping function of the circulation pump 82 and the control function for setting the temperature curve 56 may, in particular, be separate. The control is carried out via the valve 84. For example, the valve is opened and closed cyclically with a corresponding pulse-pause ratio, as described above. Alternatively, the valve 84 allows a controlled amount of water through which results in the setting of the temperature profile 56. The circulation pump 82 may be operated substantially continuously in this case.

As a result of embodiments of the present invention, which may be realized via a control device 58, 64, 73, 86, for example, a quasi-stationary circulation of hot water is set in the corresponding domestic water installation, and this ensures that during non-withdrawal times, a temperature curve which is temporally essentially constant and falls spatially monotonically is present. When a tap connection is opened, hot water is immediately available, the temperature of which increases gradually. A surge of cold water is prevented from exiting from the tap connection following the hot water.

Water and energy may be saved by means of embodiments of the present invention.

Embodiments of the present invention may be used during non-withdrawal times of hot water in order to reach a corresponding temperature setting for the withdrawal of hot water. While hot water is being withdrawn, the profile-related circulation is interrupted. The circulation is started again once withdrawal has terminated.

For example, a pulse time, which ensures an adequate supply of hot water, can be set via a circulation pump and/or a valve. When a triggering temperature is exceeded, the pulse time is maintained at a minimum value, for example, at 2 seconds and the pause time is varied, for example, in the range between 20 seconds and 600 seconds in order to ensure that water which is not too hot is available.

The invention claimed is:

1. A method for making hot water available in a domestic water installation, said domestic water installation comprising a source of hot water, a hot-water line and one or more tap connections for hot water connected to the hot-water line, the method comprising:

transporting water from said source of hot water through said hot-water line, during periods of non-withdrawal through said one or more tap connections, such that a temperature profile of water in said hot water line is substantially temporally constant and varying spatially monotonically along said hot-water line;

wherein said step of transporting includes a substantially permanent throughput of water through the hot water line with at most periodic pause time said pause times a length selected to prevent cooling of water in said hot-water line.

2. The method according to claim 1, the temperature profile includes a specific temperature at one of said tap connections within a predetermined range.

3. The method according to claim 2, wherein the specific temperature is between 27° C. and 35° C.

4. The method according to claim 1, wherein said step of transporting includes transporting water during non-withdrawal times at a substantially constant rate.

5. The method according to claim 1, wherein said step of transporting includes actuating a circulation pump to transport water through said hot-water line.

6. The method according to claim 1, wherein said step of transporting includes actuating a valve to control transport of water through said hot-water line.

7. The method according to claim 1, further comprising:

returning water to said source through a recirculation line linked to said hot-water line proximate to a last one of said tap connections.

8. A method according to claim 7, wherein said step of returning includes actuating a circulation pump to return water through said recirculation line.

9. A method according to claim 8, wherein said circulation pump is arranged proximate to said last one of said tap connections.

10. A method according to claim 8, wherein said circulation pump is arranged proximate to said source of hot water.

11. A method according to claim 1, further comprising:

returning water to a cold-water line coupled to said hot water line proximate to a last one of said tap connections.

12. A method according to claim 11, wherein said step of returning includes actuating a circulation pump positioned between said hot-water line and said cold-water line.

13. The method according to claim 11, wherein said step of returning includes actuating a valve positioned between said hot-water line and said cold-water line proximate to said last one of said tap connections.

* * * * *